United States Patent [19]

Neubauer et al.

[11] 4,342,581

[45] Aug. 3, 1982

[54] MAT WIDTH CONTROL

[75] Inventors: Jeffrey A. Neubauer, Boiling Springs, N.C.; Walter J. Reese, North Huntington, Pa.; Jimmy D. Walker, Shelby, N.C.

[73] Assignee: PPG Industries, Inc., Pittsburgh, Pa.

[21] Appl. No.: 198,744

[22] Filed: Oct. 28, 1980

[51] Int. Cl.[3] ..... C03B 37/025

[52] U.S. Cl. ..... 65/4.4; 65/2; 65/9; 156/167; 156/181; 156/444

[58] Field of Search ..... 65/2, 4.4, 9; 156/167, 156/181, 444

[56] References Cited

U.S. PATENT DOCUMENTS 3,854,917 12/1974 McKinney et al. ..... 65/4.4 X 3,883,333 5/1975 Ackley ..... 65/2

*Primary Examiner*—Robert L. Lindsay, Jr.

*Attorney, Agent, or Firm*—John E. Curley

[57] ABSTRACT

A process is described for preparing continuous strand mat which provides for more uniform density of the mat across the width of the surface on which it was prepared by using gaseous fluid directed mat edges to fold loose strands at the edges under the mat and to align the edges of the mat in a substantially straight line. The gaseous fluid, preferably air, is directed at the conveyor surface on which the mat is formed against the flow of the mat on the conveyor and in a downward direction so that portions of the mat at the sides are lifted by the air as the stray strands are folded under to form the straight edge. A further embodiment includes the formation of an edge on a continuous strand mat having an already formed substantially straight edge, during a needle operation to minimize edge waste during needling.

3 Claims, 4 Drawing Figures

MAT WIDTH CONTROL

BACKGROUND OF THE INVENTION

In U.S. Pat. No. 3,883,333, a process is described for producing a needled glass strand mat in which continuous glass strands are laid down on a moving conveyor from a plurality of feeders which are traversed across the width of the conveyor. The mat after its formation on the conveyor is passed through a needler to impart mechanical integrity to the mat by puncturing the strand mat with a multiplicity of rapidly reciprocating barbed needles. The mat leaving the needling machine is trimmed at its edges to provide a definite width of mat of given density. Mat prepared in the manner shown in this prior art process has found particular utility in the preparation of stampable, fiber glass reinforced, thermoplastic resin sheets.

In the manufacture of continuous glass strand mat as shown in this process, it is found that the edges of the mat laid down on the conveyor tend to be irregular and of lower density than the major surfaces of the mat on the conveyor. In providing a finished mat of a given width having a uniform density, it is ncessary to trim the mat as it leaves the needler, a procedure which reduces the efficiency of the process to a significant degree since the trim represents waste product. The reciprocating needler also contributes to the reduced efficiency of the process since the mat edges are forced outwardly from the mat path of travel as the needler strikes the mat on its downward stroke during its passage through the needling zone. This action in the needling zone causes the edges of the mat to become thinner than the main body of the mat and these edges must be trimmed away from useful, uniform density mat emerging from the needler.

SUMMARY OF THE INVENTION

It is an object of the invention to achieve substantial reduction in waste encountered during the production of continuous strand mat.

Another object of the invention is to improve efficiencies in the manufacture of continuous strand mat which is being needled to provide integrity to the mat.

A further object of the invention is to improve the efficiency of continuous glass strand mat making by reducing edge trim in the process exemplified in U.S. Pat. No. 3,883,333.

Thus, in accordance with the instant invention, continuous strand mat, particularly unbonded continuous fiber glass strand mat, which has been formed by depositing a plurality of strands on a moving mat forming surface is treated with gaseous fluid at the edges, on both sides of the mat, as it moves on the forming surface. The gaseous fluid is fed on both sides of the mat as it travels on the forming surface by directing the fluid downwardly and inwardly toward the mat forming surface. The flow of the gaseous fluid is preferably directed at the mat edges at right angles to the flow of the mat on the mat forming surface but may be directed in a direction countercurrent to or slightly co-current to the flow of mat on the conveyor. By directing the gaseous fluid toward the edge of the mat on the forming surface on each side and in a direction downwardly and inwardly of the edge of the mat it is found that the mat edge is lifted slightly from the mat forming surface. At the same time that the mat is lifted, it is also found that the low density edges which are generally formed of strand loops and loosely laying strands are folded under the lifted mat at the point where the fluid is raising the mat and a generally, uniform, straight edge is formed on a continuous basis as the edges of the mat pass the point where the gas is striking the mat forming surface at the downward and inward angles.

In a further embodiment of the invention, mat with substantially straight edges is fed to a needling zone and the edges are forced during their passage into the needling zone inwardly until the first row of needles strike it and then are held in a straight line at the edges until the mat has passed at least five rows of needles. By forcing the mat through the first rows of needles in a straight line an edge which is straight is provided and after those edges pass the first five rows of needles, the tendency for the edge to distort as the remaining rows of needles penetrate the mat is substantially reduced so that edge trim of mat removed from the needling zone is held to a minimum.

BRIEF DESCRIPTION OF THE DRAWINGS

While the novel features of the invention are set forth with particularity in the appended claims, a more full and complete understanding of the invention will be had by referring to the description of preferred embodiments as set forth herewith and as may be seen in the accompanying drawings in which:

DESCRIPTION OF THE PREFERRED EMBODIMENTS

Figure 1:
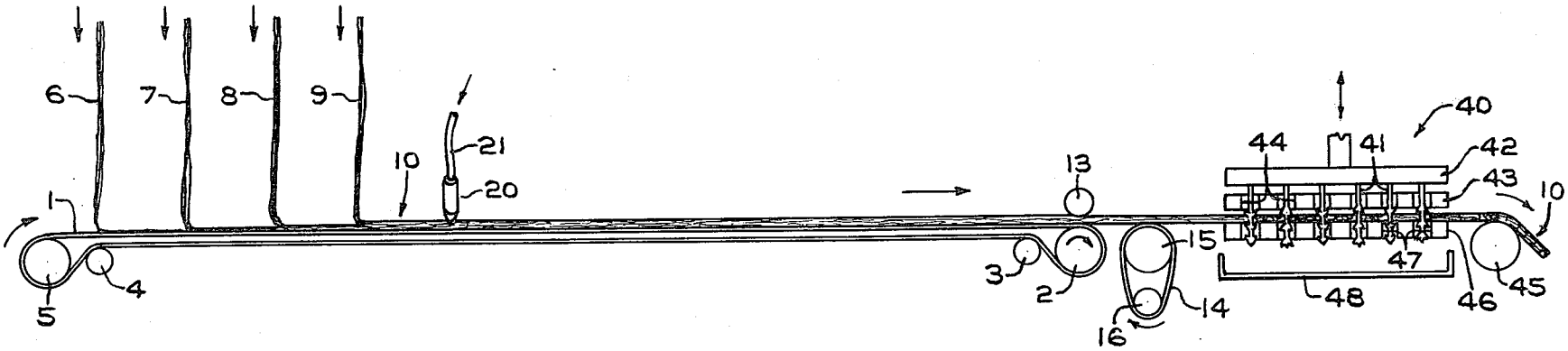
FIG. 1 is a schematic side elevation of a continuous strand mat making line on which continuous strand mat is formed and needled.

Turning to FIG. 1 there is shown a conveyor 1 which is an endless belt driven by a roll 2 over rolls 3 and 4 and around a tracking roll 5. Strands 6, 7, 8, and 9 are shown being projected in a downward direction onto the conveyor 1. These strands are also moving in a direction across the conveyor surface during the mat making operation which will be discussed more fully in connection with FIGS. 2 and 3. While four strands are shown in the drawing, this is for illustrative purposes only, the number can be greater or lesser. Strands in excess of the four shown may be employed and in fact in one commercial application of the instant invention in mat making, applicants have employed as many as twelve of these strand feeders to lay strand down on the mat conveyor 1.

Mat 10, formed by depositing successive layers of strand 6, 7, 8, and 9 on the moving belt 1 is moved in the direction shown by the arrows on the drawing to the needling device 40. During its passage along the conveyor belt 1 to the needling device mat 10 passes the fluid treating jet 20 which is fed through a fluid inlet line 21, to be treated in accordance with the invention to provide a substantially straight edge. This will be more fully described in discussing FIGS. 2 and 3. After passing jet 20, the mat is passed through an oven (not shown) where it is subjected to drying. The mat is then passed between rolls 2 and 13 and is delivered to the surface of chain 14 which is driven over the surface of a drive roll 15 and an idler roll 16.

Mat 10 after passing over the roll 15 on the surface of chain 14 is then fed to the needler 40 which as indicated by the arrows reciprocates in a vertical direction to move the needles 41 in and out of the mat 10 as it travels through the device 40 to mechanically bond by entanglement the strands which make up the mat 10. Drive roll 45 pulls the mat 10 out of the needler 40 for final trimming.

Figure 2:
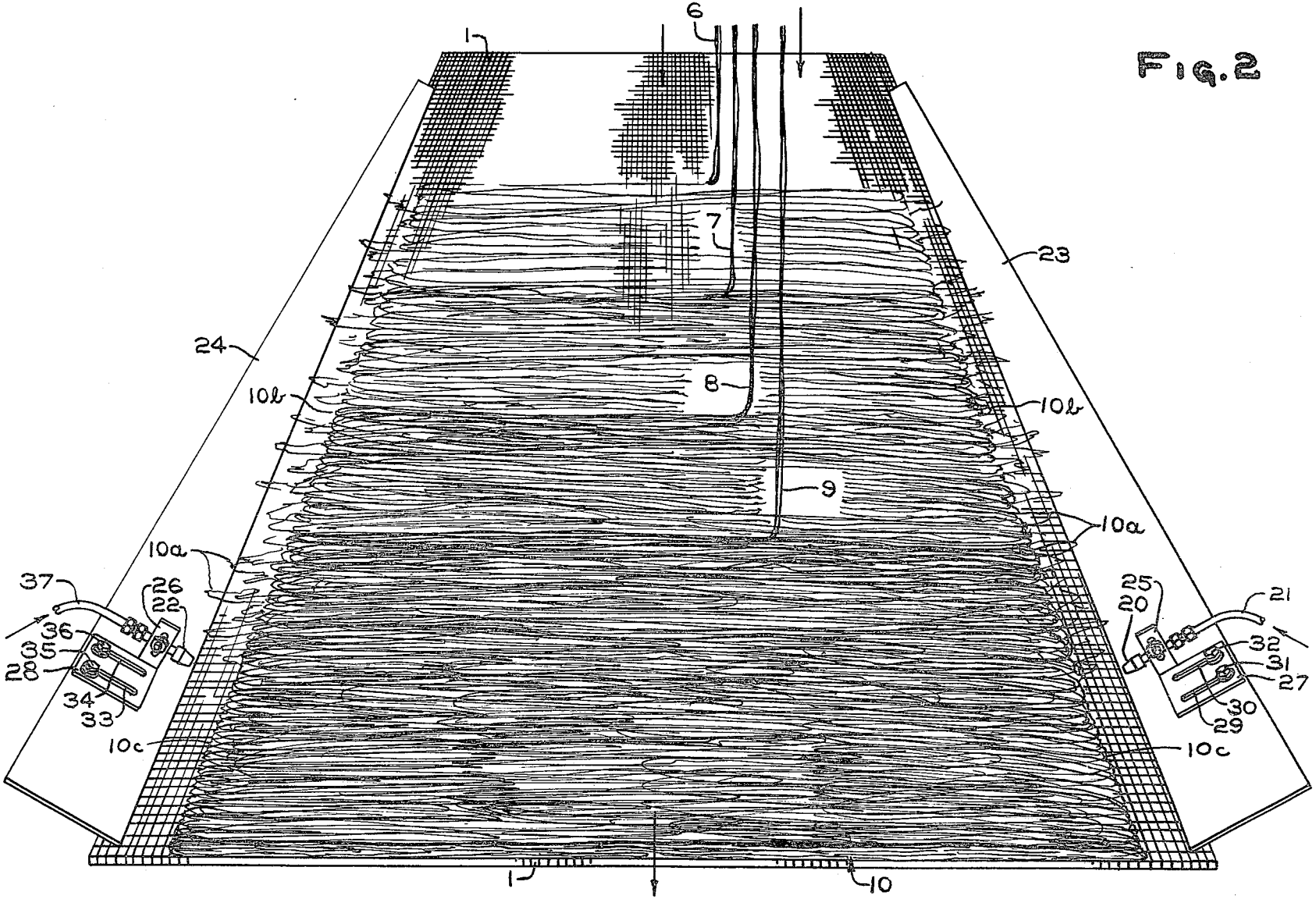
FIG. 2 is an isometric schematic view of the mat making line of FIG. 1 looking upstream from the direction of travel of the mat.
Figure 3:
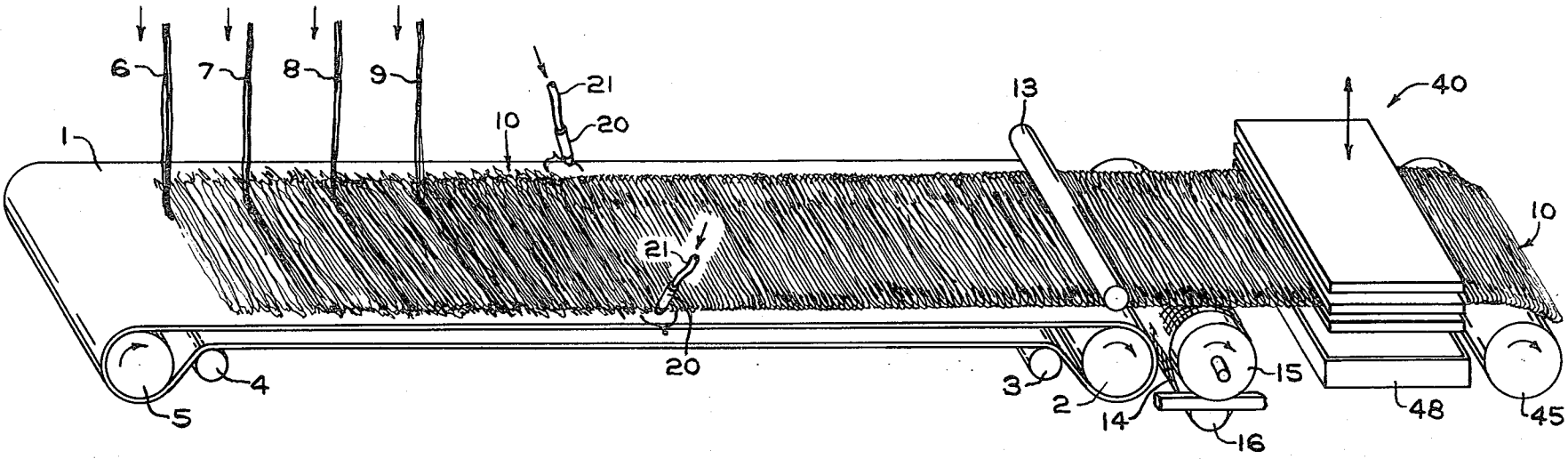
FIG. 3 is a schematic, isometric view of FIG. 1.

Turning now to FIGS. 2 and 3, the treatment of mat 10 in accordance with the invention will be described in more detail. As shown in FIG. 2, strands 6, 7, 8, and 9, are being traversed across the mat conveyor 1 as the conveyor 1 moves in the direction indicated by the arrows toward the jets 20 and 22. A pair of guide rails 23 and 24 parallel the conveyor chain 1 and are positioned to slope toward the conveyor 1 downwardly toward its surface so that strands at the edges of the conveyor 1 are caught thereon and will fall back toward the conveyor 1 as it moves through the mat forming area. The strands 6, 7, 8, and 9 being laid down on the conveyor 1 are attenuated from either a fiber glass forming bushing or from a glass fiber forming package. In either event the glass strands are attenuated by pulling them from a bushing or a forming package preferably using belt attenuators as shown in U.S. Pat. No. 4,158,557 and U.S. Pat. No. 3,883,333. As shown in both of these patents the strands are pulled downwardly and they are also traversed across the mat conveyor 1 to provide the requisite width of mat on the conveyor 1 that is desired. Either of the systems can be employed in the present mat making system to lay down the strands 6, 7, 8, and 9. Other type strand lay down systems may also be employed, if desired. Thus, wheel pullers which reciprocate to accomplish traversing of strand across a conveyor such as described in U.S. Pat. No. 3,616,143, can be used as can staggered pullers from a stationary position such as shown in U.S. Pat. No. 2,855,634. Regardless of the methods utilized to lay down strand to form mat, the edges tend to be light in density compared to the main body of mat formed and as shown in FIG. 2, the edges on both sides of conveyor 1 have many places where irregular patterns of the strands 6, 7, 8, and 9 indicated as 10*a* can be seen with the strands in some instances riding on the rails 23 and 24 and on the edges of the conveyor 1. As the mat 10 moves forward, it passes the jet devices 20 and 22 located on each side of the conveyor 1. As shown, the jets 20 and 22 are mounted on brackets 25 and 26 respectively. These brackets 25 and 26 are each mounted on plates 27 and 28 respectively. Plate 27 has slots 29 and 30 provided with screws 31 and 32 so that the bracket 25 can be moved forward or backward in relation to the surface of the conveyor 1. Slots 29 and 30 are sufficiently wide so that the plate 27 can be turned to angle the jet 20 on the bracket 25 from the right angle position shown in the drawing with respect to the moving mat 10 to upstream or downstream positions at lesser angles. Plate 28 similarly is provided with slots 33 and 34 and screws 35 and 36 to accomplish the same flexibility with jet 22 in its positioning in relation to the mat conveyor 1 and mat 10. Jet 20 is supplied with a gaseous fluid through line 21 and jet 22 is supplied through a line 37.

The gaseous fluid treatment zone is defined by the gaseous fluid streams which are provided by the jets 20 and 22 on either side of the mat. While they are shown in the drawing to be positioned directly opposite each other, the jets 20 and 22 could be located in a staggered relationship with respect to each other so long as both are positioned beyond the strand feeding area of the mat conveyor 10 so that they treat the edges of a fully formed mat.

As the mat 10 passes the jets 20 and 22 in the gaseous fluid treatment zone, gaseous fluid is directed downwardly and inwardly of the mat edges. The downward and inward flow of gaseous fluid sweeps the unevenly distributed strands 10*a* lying on the edges of the conveyor 1 and rails 23 and 24 inwardly toward the dense body of the mat indicated as 10*b*. In addition, the gaseous fluid is directed to the edges of the mat 10 in sufficient quantity and at velocities so that the dense edge 10*b* of the mat 10 is lifted slightly off of the surface of the conveyor 1. This dual action i.e., the lifting of the edges 10*b* of mat 10 and the sweeping of strands 10*a* toward the mat 10 off of the edge of the conveyor 1 and rails 23 and 24 results in the loose strands 10*a* being swept into the main body of the mat and the edge 10*b* being folded to provide substantially straight edge 10*c* to mat 10 as the mat passes by the gaseous treatment zone.

The jets 20 and 22 in operation are directed preferably at an angle normal to the longitudinal axis of the traveling mat 10. In some instances, it may be found desirable to have the jets 20 and 22 pointing slightly upstream of the path of travel of the main mat 10 and it has been also found that the lifting and folding action can also be accomplished by pointing the jets 20 and 22 slightly downstream. The important consideration, however, regardless of the exact positioning of the jets 20 and 22 with respect the the mat edges of mat 10 is that the gaseous fluid projected from them strikes the conveyor 1 and loose strands 10*a* in such a way that the edges 10*b* of mat 10 lift slightly from the surface of mat conveyor 1 while the loose strands 10*a* are swept under the raised mat. When the adjustment is made to provide this action, the folding of the edges in a substantially straight line occurs to provide the edges 10*c*.

As can be seen, the jets 20 and 22 point downwardly and while the specific angle of downward pitch from a horizontal plane is not critical it will vary depending upon where the dense portion 10*b* of the mat 10 lies on the conveyor 1, the number and position of the loose strands 10*a* on the edges of conveyor 1 and the velocity and volume of air passed through nozzles 20 and 22. As a practical matter, the jets 20 and 22 are pointed downwardly so that the gaseous fluid issuing from them strikes the conveyor 1 in a downward and inward direction close to the dense edges 10*b* thereof or at the point along the mat length at each edge where it is desired to maintain a substantially straight edge on either side. In practice, the fluid is normally impinged on the surface of conveyor 1 within an inch of the location of the portion of the mat where the dense edge 10*b* is located. It is important, however, in directing the fluid at the mat edge 10*b* that a substantial portion of the fluid strikes the surface of the conveyor 1 to close the dense portion 10*b* of the mat to provide for adequate lift so that the loose strands 10*a* will tuck underneath the lifted area to provide the even fold to mat 10 and provide edges 10*c*.

In supplying gaseous fluid to the jets 20 and 22 any gas may be employed such as nitrogen, oxygen, air and the like. As a practical matter, air is the preferred gas and is typically fed to the jets from a suitable compressed air source usually in the range of 20 to 80 psig.

The conveyor 1 is preferably a metal mesh chain though the solid belt conveyors may also be employed.

Turning to FIG. 3, the mat making line of FIG. 1 is shown in an isometric view to indicate the passage that the mat takes to reach a further edge control element used in making mat which is being needled after it has been formed with a straight edge 10*c* as provided by the gaseous treatment systems shown most clearly in FIG. 2, above discussed. Thus as shown in FIG. 3, the strands 6, 7, 8, 9, are deposited on conveyor 1 and the strands reciprocate or traverse the width of conveyor 1 as they are deposited thereon while conveyor 1 continuously moves from left to right in a straight path toward the needler 40.

The mat 10 after passing the gaseous treatment zone defined by the jets 20 and 22 is then passed through the rollers 13 and 2 to the chain 14 driven by roller 15 from which it passes to the needler 40.

The mat 10 entering needler 40 has substantially straight edges on either side thereof. The needler 40 as shown more clearly in FIG. 1 is generally comprised of a needle board 42 which carries on its under surface a plurality of needles 41 arranged in rows across the machine, the rows of needles being sufficient in length to insure that the width of the mat 10 passing through the needling area is penetrated throughout its width by the needles 41. A stripper plate 43 is provided above the mat 10 in the needler 40 and is provided with holes 44 through which the needles 41 pass on the downward stroke of the needle board 42. On the upward stroke of needle board 42 the plate 43 assists in stripping fibers from the needles 41 which as shown in the drawing are barbed in either an upward or downward direction or in both directions depending on the desired result of the needling. A bottom plate 46 is also provided and similarly has rows of holes 47 therein to accommodate needles 41 when the needle board 42 is in a downward stroke. This plate, 46 and associated holes 47, like stripper plate 43 and its associated holes assists in removing fibers from needles 41 when the needles 41 are withdrawn from the holes 47. This stripping of the fibers from the needles it will be understood occurs because the mat 10 is being positively pulled by roll 45 through the needler and loose fibers pushed through holes 47 or pulled into holes 44 are dragged with the main mat 10 from the surfaces of the holes as the mat strands pass by them. A trough 48 is provided in the bottom of the needler 40 to catch loose fibers that fall from the needling zone through the bottom plate 46.

It has been found further that if mat provided with the straight edge, in accordance with the embodiment of the invention hereinbefore described with respect to FIGS. 1 and 2 is in a relatively dry state i.e., less than two percent moisture therein and is composed of materials such as glass fibers and synthetic organic materials such as nylon, polyesters, and the like in a continuous strand form that further control of the mat edges can be realized if such mat is to be needled. Thus, as shown in FIG. 3 the continuous strand mat with substantially straight edges is fed to the needling machine 40 to provide mechanical integrity to the continuous strands so that the mat can be physically handled after it is removed from the needler 40. To minimize waste of material in a continuous mat form being fed to such a needler, it is important that the material have a fairly straight edge going into the needling machine and that it be provided with a substantially straight edge as it passes through the needling machine to minimize the amount of edge trim necessary to provide finished mat.

Figure 4:
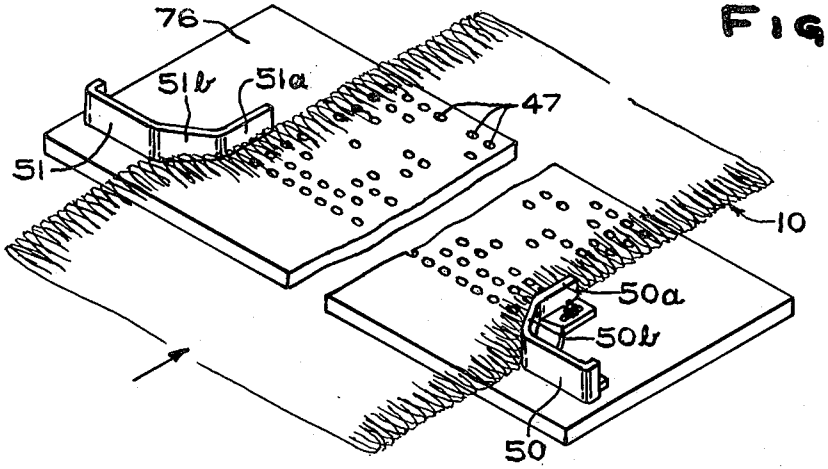
FIG. 4 is a schematic, isometric view of the bottom plate of the needling device 40 of FIGS. 1 and 3.

In accordance with a further embodiment of this invention, therefore, and referring in particular to FIG. 4, the straight edge mat 10 fed to the needler is provided in a width slightly in excess of the width that is desired in the final product. This mat 10 is passed between two brackets 50 and 51 which are curved slightly towards the entrance of the needler 40 of FIG. 3. Brackets 50 and 51 are mounted on the bottom plate 46 of the needler 40 and as shown in FIG. 4 are mounted in such a manner that they provide a funnel shaped entrance for the mat 10 as it enters the needling machine 40. This funnel shaped entrance is provided by the slightly forwardly inclined planes 50*b* on bracket 50 and 51*b* on bracket 51. The mat in its travel along the planes formed by the angled portion 51*b* and 50*b* of brackets 51 and 50 respectively has its edges forced onto the surfaces 51*a* of bracket 51 and 50*a* of bracket 50 which define the final width desired for the mat passing through the needling zone. The needling zone is the zone defined by the holes 47 of FIG. 4 which as can be readily appreciated are aligned in rows across the width of the mat 10 passing over them. It has been found especially in the utilization of continuous strand mat made out of fiber glass that there is some criticality with respect to the length of the straight portions 51*a* and 50*a* that can be employed in controlling the mat width inside of the needling machine. Thus, in the preferred embodiment of the instant invention, the length of the straight elements 51*a* and 50*a* of the brackets 51 and 50 respectively are controlled so that they cover approximately five rows of holes and preferably between the first five and eight rows of holes in the needling machine. When side arms 51*a* and 50*a* of the brackets 51 and 50 are elongated to encompass more than eight rows of holes in a needle board containing for example, 38 rows it has been found that the holes downstream of the elements 51*a* and 50*a* plug up with loose strands formed during the needling operation itself to an undesirable degree causing frequent shutdowns for cleaning. Yet, suprisingly it has been found that in the short distance utilized, i.e., normally the first three to five inches of travel across the needling zone per se that a straight edge mat can be maintained despite the weight of the needle board striking the mat 10 on the downward stroke of the needling operation. Previous to employing the initial guiding system for edge control of mat entering the needling machine, it was found that the weight of the needle board 42 was such in a fiber glass needled mat operation that the straight edge formed in accordance with the the first embodiment of the invention described herein before was distorted by the reciprocation of that board to provide thin edges to the mat during its travel through the needling machine. By recourse to the instant embodiment of the invention, substantially, all of mat fed to the needling machine is utilized as final product because the excessive edge fed to the machine is compressed during passage along the inclined planes formed by elements 51*b* and 50*b*. The initial maintenance of a straight, defined edge for the first several rows of the needling machine is sufficient to provide integration of the edges by the first few rows of needles so that the mat travelling through the remaining portion of the needler remains in a straight edge condition. This occurs because the mat has been mechanically bonded throughout its width by the first few rows of needles. The mat emerging from this needler requires little or no edge trimming and in commercial practice has been found to require less than a half an inch edge trim on either side of the finished mat which normally is over 100" in width.

The edge control system of the instant invention has been utilized by the applicants in forming glass fiber continuous strand mat and has contributed in both embodiments to the formation of a needled fiber glass mat with extremely low waste being experienced in trimming light-weight edges from the edges of mat formed in this manner. Thus, in a typical application of the instant invention to provide a needled fiber glass continuous strand mat, glass strands were reciprocated across the surface of a conveyor such as shown in FIGS. 1, 2 & 3. The glass fiber strands were laid down on the mat conveyor 1 at speeds of 1250 ft. per minute and as they traveled to the surface of the conveyor 1 the strands were reciprocated across the conveyor and back in an eight second cycle using a feeding and traversing system similar to that shown in U.S. Pat. No. 3,883,333. The conveyor 1 was moving continuously toward the needler 40 at a speed of about 9.2 feet per minute. The continuous glass strands fed to the mat surface contained moisture at a level of between 6 to 8 percent by weight. The mat 10 laid down on the mat conveyor 1 had a width prior to reaching the gaseous treatment zone of about 120 inches including the ragged edges of strand formed in placing the strands on the conveyor 1.

The nozzles were placed at right angles to the longitudinal axis of the mat path of travel and were pointed downwardly and inwardly toward the edges of the mat 10 to impinge air from a 60 psig compressed air source on the conveyor 1 on either side thereof to provide a mat width of 102 inches after the strands 10*a* were swept from the surface of conveyor 1 and mat 10 was lifted to permit folding by the air. The nozzles were pointed downwardly at a 45° angle from horizontal and inwardly toward the edge of the mat on both sides.

As mat 10 passed adjacent to the nozzles 20 and 22, the straight edges 10*c* were formed by the lifting action of the air on the mat 10 and the folding of the loose strands 10*a* underneath the lifted mat edges 10*b*.

The mat 10, with the straight edges 10*c* provided thereon in the gaseous treatment zone then was dried in an oven, not shown, to a moisture content of between 0.1 to 1 percent prior to entering the needler 40.

The straight edge mat was fed to needler 40 at the entrance thereto provided by brackets 50 and 51. The sloped sections 50*b* and 51*b* were sized to accommodate the 102 inch width and the straight section 50*a* and 51*a* were sized to reduce this width to 101 inches. The mat 10 passing through the needler was punched with sufficient needles arranged in parallel but staggered rows to provide in the finished mat 170 to 190 penetrations per square inch at a needle board reciprocation of 350 strokes per minute. The mat speed through the needling zone was about 16 feet per minute. The elements 50*a* and 51*a* were three inches each in length and bordered the first eight rows of holes 47 of the bottom plate 46.

The mat emerging from the needler 40 was 101 inches wide and was trimmed on each side with a conventional slitter (not shown) to provide a final mat width of 100 inches. As will readily be appreciated by the final trim of one inch from a mat that had a width of 120 inches or more in the forming zone, i.e., the zone where it was fed to the surface of conveyor 1, a minimal loss of material occurred during the mat manufacture.

In the operation of the mat line and needler of FIGS. 1, 2, 3, and 4, prior to the installation of the instant invention edge trim waste to produce finished mat product was averaging 49 pounds per operating hour. When the invention herein before described was employed to provide the straight edges prior to and during needling mat edge trim waste was reduced dramatically to an average of about 4.3 pounds per operating hour.

The gaseous treatment herein described may be employed on either wet or dry mat. Further while the invention has been described with respect to the formation of needled fiber glass continuous strand mat it can be employed on any continuous strand mat using, for example, continuous strands of synthetic fibers such as nylon, polyester, and the like.

While the continuous strand mats formed in the instant application do not contain any binders on them such as resins sprayed thereon or deposited as solids thereon to provide integrity thereto as commonly practiced in the continuous glass strand mat making art the invention can be employed in mat making operations such as those. For example, it is common practice to deposit resin particles on continuous glass strand mat and to subsequently heat the resins to bond the continuous strands together. In utilizing the instant invention in such an operation, the gaseous treatment should preferably be applied to mat edges prior to bonding the continuous strands to obtain best results. The edge control system used prior to and during the needling of continuous strand mat herein described can of course be employed on either wet or dry mat.

While the invention has been described with reference to certain specific embodiments it is not intended to be so limited except insofar as appears in the accompanying claims.

We claim:

1. In the manufacture of needled continuous strand mat wherein continuous strands in mat form are moved from a conveying surface through a needling zone in which the strands are entangled to provide mechanical bonding to the strands and integrity to the mat of strands by penetrating the mat repeatedly with rows of barbed needles, the improvement comprising moving the side edges of the mat inwardly as they enter the needling zone, confining the side edges so moved as they pass under the first row of needles in a straight line to form a straight edge to the mat on each side of the mat as the first row of needles penetrate the mat across its width thereof, continuing to confine the edges of the mat in a straight line until a few rows of needles have penetrated the mat across its width, releasing the edges of the mat after the first few rows of needles have penetrated it and continuing to needle the mat across its width throughout the remainder of the needling zone.

2. The method of claim 1 wherein the needled continuous strand mat is a glass fiber strand mat.

3. The method of claim 1 in which the edges of the mat are treated to provide edges which are substantially straight immediately before the mat enters the needling zone.

* * * * *